US011661934B2

(12) United States Patent
Redschlag et al.

(10) Patent No.: US 11,661,934 B2
(45) Date of Patent: May 30, 2023

(54) CLAMPING DEVICE FOR A DELIVERY DEVICE

(71) Applicant: QONQAVE GMBH, Wernau (DE)

(72) Inventors: Lars Redschlag, Stuttgart (DE); Alois Krutzenbichler, Starnberg (DE); Raymond Ritschka, Weissach (DE); Jochen Baumann, Stuttgart (DE)

(73) Assignee: QONQAVE GMBH, Wernau (DE)

( * ) Notice: Subject to any disclaimer, the term of this patent is extended or adjusted under 35 U.S.C. 154(b) by 1169 days.

(21) Appl. No.: 16/318,954

(22) PCT Filed: Jul. 20, 2017

(86) PCT No.: PCT/EP2017/068321
§ 371 (c)(1),
(2) Date: Jan. 18, 2019

(87) PCT Pub. No.: WO2018/015477
PCT Pub. Date: Jan. 25, 2018

(65) Prior Publication Data

US 2019/0301441 A1 Oct. 3, 2019

(30) Foreign Application Priority Data

Jul. 20, 2016 (DE) ..... 10 2016 113 386.8

(51) Int. Cl.
*F04B 43/12* (2006.01)
*F04B 43/08* (2006.01)
(Continued)

(52) U.S. Cl.
CPC ..... *F04B 43/12* (2013.01); *F04B 43/084* (2013.01); *F04B 43/086* (2013.01);
(Continued)

(58) Field of Classification Search
CPC ..... F04B 43/12; F04B 43/084; F04B 43/086; F04B 43/1223; F04B 45/06; F04B 45/08
(Continued)

(56) References Cited

U.S. PATENT DOCUMENTS 2,015,123 A 9/1935 Pennell
4,034,773 A * 7/1977 Huggins ..... A61M 39/285 251/9

(Continued)

FOREIGN PATENT DOCUMENTS

CA 2422579 A1 3/2003
DE 10 2014 118 924 A1 6/2016

(Continued)

OTHER PUBLICATIONS

Japanese Office Action dated Apr. 20, 2021, issued in corresponding Japanese Patent Application No. 2019-502655 (and English Machine Translation).

(Continued)

*Primary Examiner* — Philip E Stimpert
*Assistant Examiner* — Dnyanesh G Kasture
(74) *Attorney, Agent, or Firm* — Posz Law Group, PLC

(57) ABSTRACT

A clamping device includes at least one clamp-in unit for clamping in at least one flexible-tube delivery element of a delivery device, wherein, for a delivery of a medium, a drive force is exertable on said flexible-tube delivery element by a drive unit of the delivery device, when the flexible-tube delivery element is arranged in the clamp-in unit, the clamp-in unit is configured to clamp the flexible-tube delivery element so that it is curved as a whole, and includes at least one clamping element, which includes a convex abutment element realizing an abutment surface for the flexible-tube delivery element, wherein the clamp-in unit includes at least the clamping element, which has at least one angled clamp- (Continued)

Figure 1:
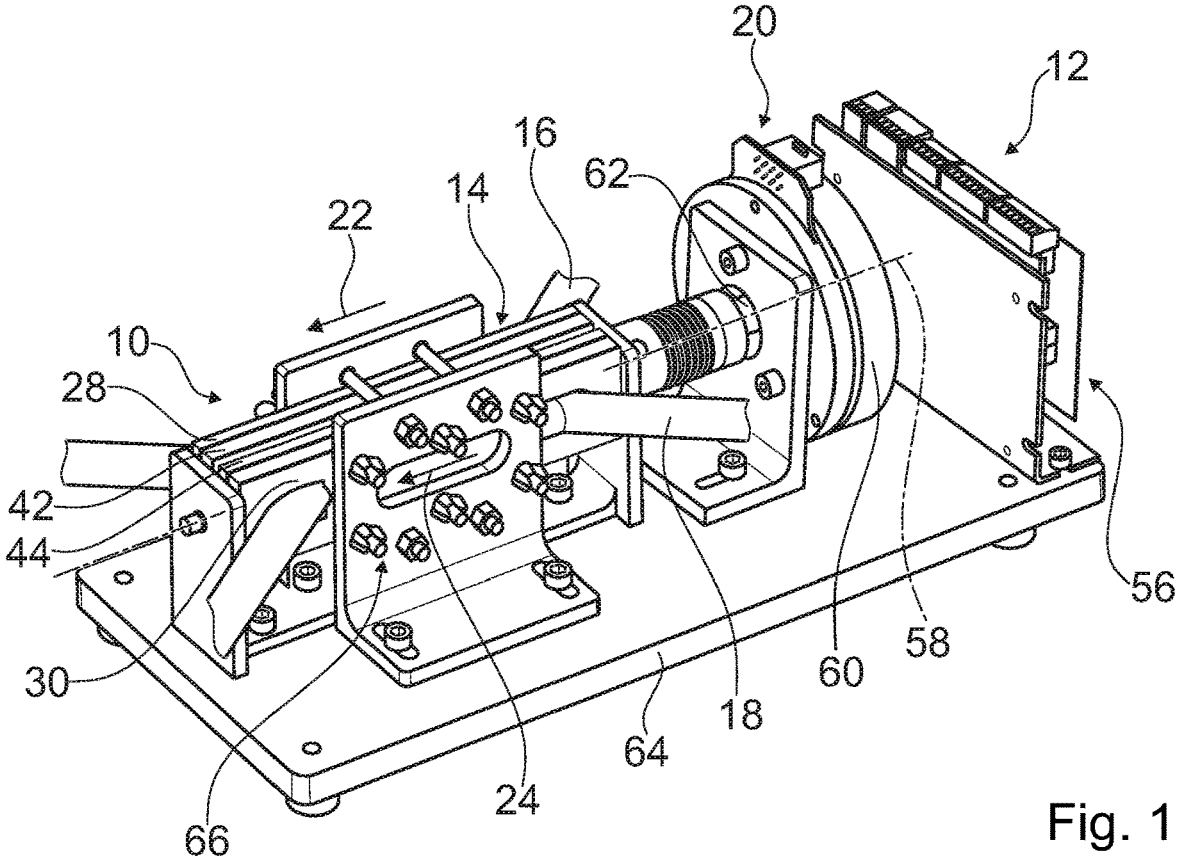

ing surface, and which includes at least one adhesive element that is arranged on the clamping surface of the clamping element.

8 Claims, 3 Drawing Sheets

(51) Int. Cl.
*F04B 45/08* (2006.01)
*F04B 45/06* (2006.01)

(52) U.S. Cl.
CPC ..... *F04B 43/1223* (2013.01); *F04B 45/06* (2013.01); *F04B 45/08* (2013.01)

(58) Field of Classification Search
USPC ..... 251/4, 6–10
See application file for complete search history.

(56) References Cited

U.S. PATENT DOCUMENTS

| | | | | |
|---|---|---|---|---|
| 4,155,362 | A * | 5/1979 | Jess | A61M 5/14232 604/890.1 |
| 4,493,710 | A * | 1/1985 | King | A61M 5/1689 128/DIG. 13 |
| 2008/0038128 | A1 | 2/2008 | Haar | |
| 2008/0247892 | A1* | 10/2008 | Kawasumi | F04B 43/12 417/476 |
| 2017/0350383 | A1 | 12/2017 | Beenker | |
| 2017/0350385 | A1 | 12/2017 | Beenker | |
| 2018/0003166 | A1 | 1/2018 | Beenker | |

FOREIGN PATENT DOCUMENTS

| | | | |
|---|---|---|---|
| DE | 10 2014 118 925 | A1 | 6/2016 |
| DE | 10 2014 118 926 | A1 | 6/2016 |
| EP | 1317626 | A1 | 3/2002 |
| EP | 1834658 | A1 | 3/2006 |
| GB | 623527 | A | 5/1949 |
| GB | 800154 | A | 8/1958 |
| WO | 2016/097153 | A1 | 6/2016 |

OTHER PUBLICATIONS

Indian Office Action dated Dec. 31, 2020, issued in corresponding Indian Patent Application No. 201937005785 (and English Machine Translation).

Russian Decision to Grant dated Jan. 28, 2021, issued in corresponding Russian Patent Application No. 2019104022.

Office Action dated Sep. 17, 2021, issued in corresponding Canadian Patent Application No. 3,031,248.

Russian Decision to Grant dated Mar. 24, 2021, issued in corresponding Russian Patent Application No. 2019104022 (and English translation).

German Search Report dated Mar. 31, 2017 in corresponding German Patent Application No. DE 10 2016 113 386.8 (and English translation).

International Search Report dated Oct. 25, 2017 issued in corresponding International Application No. PCT/EP2017/068321.

International Preliminary Report on Patentability dated Jan. 22, 2019 in corresponding International Application No. PCT/EP2017/068321.

Russian Office Action dated Aug. 28, 2020 issued in corresponding RU Patent Application No. 2019104022 (and English translation of the Summary).

Australian Office Action dated Mar. 6, 2020 issued in corresponding AU Patent Application No. 2017299192.

Chinese Office Action dated Dec. 18, 2019 issued in corresponding CN Application No. 201780058007.0 (with English translation).

Notice of Allowance dated May 30, 2022 received in corresponding Canadian Patent Application No. 3031248.

* cited by examiner

CLAMPING DEVICE FOR A DELIVERY DEVICE

CROSS REFERENCE TO RELATED APPLICATIONS

This application is a U.S. national stage application of PCT/EP2017/068321 filed on Jul. 20, 2017, which is based on German Patent Application No. 10 2016 113 386.8 filed on Jul. 20, 2016, the contents of which are incorporated herein by reference.

STATE OF THE ART

The invention concerns a clamping device according to the preamble of claim 1.

From EP 1 834 658 A1 a clamping device for a delivery device is already known. The known delivery device comprises at least one clamp-in unit for a clamping-in of a flexible-tube delivery element of the delivery device, wherein, for a delivery of a medium, a drive force is exertable on said flexible-tube delivery element by means of a drive unit of the delivery device, at least in a state when it is arranged in the clamp-in unit.

Moreover, from EP 1 317 626 B1, DE 10 2014 118 924 A1, DE 10 2014 118 925 A1 and DE 10 2014 118 926 A1 delivery devices at least for a conveyance of a delivery medium are already known, comprising at least one conveying space element that is embodied in a rigid fashion and at least partly delimits a conveying space, and comprising at least one elastically deformable conveying element that is embodied as a membrane element and delimits the conveying space together with the conveying space element. The conveying element is implemented differently from a flexible-tube conveying element and is fixated on the conveying space element.

The objective of the invention is in particular to provide a generic device having improved characteristics regarding a gentle clamping of a flexible-tube delivery element as well as an effective delivery of a medium by a clamping of the flexible-tube delivery element. According to the invention the objective is achieved by the features of patent claim 1 while advantageous implementations and further developments of the invention may be gathered from the dependent claims.

ADVANTAGES OF THE INVENTION

The invention is based on a clamping device for a delivery device, with at least one clamp-in unit for clamping in at least one flexible-tube delivery element of the delivery device, wherein, for a delivery of a medium, a drive force is exertable on said flexible-tube delivery element by means of a drive unit of the delivery device at least in a state when it is arranged in the clamp-in unit.

It is proposed that the clamp-in unit is configured to clamp the flexible-tube delivery element in such a way that it is curved as a whole when viewed in a cross section extending transversely to a delivery direction of the flexible-tube delivery element, wherein the clamp-in unit comprises at least one clamping element, which in particular differs from a drive element of the drive unit, and which comprises a convex abutment element realizing an abutment surface for the flexible-tube delivery element, wherein the clamp-in unit comprises at least the clamping element, which has at least one angled clamping surface, wherein the clamping element comprises at least one adhesive element that is arranged on the clamping surface of the clamping element. "Configured" is in particular to mean specifically designed and/or specifically equipped. By an element and/or a unit being configured for a certain function is in particular to be understood that the element and/or the unit fulfill/fulfills and/or realize/realizes said certain function in at least one application state and/or operation state.

"Clamped in such a way that it is curved" is in particular to mean an arrangement of the flexible-tube delivery element as a whole in the clamp-in unit, wherein the flexible-tube delivery element is fixated, preferably with two peripheral regions that face away from each other, between a clamping element and a further clamping element of the clamp-in unit and is curved at least in one partial region, in particular in at least one partial region that is at least substantially free from a clamping surface contact of the clamp-in unit. Preferentially, in a state when the flexible-tube delivery element is arranged as a whole in the clamped-in unit, at least one partial region of the flexible-tube delivery element, which is at least substantially free from a clamping surface contact of the clamp-in unit, is arranged in a curved fashion, in particular under the influence of at least one or a plurality of convex and/or concave element/elements of the clamp-in unit. Viewed in a cross section extending transversely to a delivery direction of the flexible-tube delivery element, the flexible-tube delivery element may be arranged in in the clamp-in unit in such a way that it is curved over its entire extension or merely in a partial region, in particular in at least one partial region that is at least substantially free of a clamping surface contact of the clamp-in unit, in particular in a delivery-free state of the flexible-tube delivery element. Preferably, in a clamping-in of the clamp-in unit, viewed in a cross section extending transversely to a delivery direction of the flexible-tube delivery element, the flexible-tube delivery element is transferred, starting from a circular shape, into a curved, in particular arc-like, shape, in which inner wall regions of the flexible-tube delivery element abut on each other. Preferentially, in particular at least more than 30%, preferably at least more than 50% and particularly preferably at least more than 70% of a total extension of an inner wall of the flexible-tube delivery element, abut on each other in a state when the flexible-tube delivery element is clamped by the clamp-in unit, in particular in a delivery-free state of the flexible-tube delivery element. Preferably, in particular at least more than 5%, preferentially at least more than 10% and especially preferentially at least more than 20% of a total extension of an inner wall of the flexible-tube delivery element are free of a contact with an opposite-situated inner wall region in a state when the flexible-tube delivery element is clamped in by the clamp-in unit, in particular in a delivery-free state of the flexible-tube delivery element. By a "delivery-free state" is in particular a state of the flexible-tube delivery element to be understood in which the flexible-tube delivery element is in particular decoupled from an impact of a drive force for a delivery of a medium through the flexible-tube delivery element. For a delivery of a medium, the inner wall region that is free of a contact with an opposite-situated inner wall region is preferably configured for an elastic deformability.

The flexible-tube delivery element preferentially has an annulus-shaped cross section, in particular in a state when separate from the clamp-in unit. It is however also conceivable that the flexible-tube delivery element has a different cross section that is deemed expedient by someone skilled in the art like, for example, an annulus-shaped cross section with lateral projections, a polygonal cross section, or the like. The clamp-in unit is preferably configured for clamping the flexible-tube delivery element, as a whole in an at least substantially arc-shaped fashion when viewed in a cross section extending transversely to a delivery direction of the flexible-tube delivery element, wherein in particular opposite-situated inner wall regions of the flexible-tube delivery element abut on each other. Especially preferentially the flexible-tube delivery element has, in a state when clamped by the clamp-in unit, an arc-like shape at least in a middle region of the flexible-tube delivery element, wherein peripheral regions of the flexible-tube delivery element which are adjacent to the middle region, and in which in particular at least more than 50% of a total extension of an inner wall of the flexible-tube delivery element abut on each other, extend, starting from the middle region, tangentially away from the middle region. It is however also conceivable that the peripheral regions extend, starting from the middle region, away from the middle region, corresponding to a radius of the middle region. The flexible-tube delivery element preferably has, in a state when clamped by the clamp-in unit, in each of its peripheral regions one vertex point, respectively inflection point, in which a curvature of the flexible-tube delivery element is at its maximum. Preferentially the flexible-tube delivery element has, in a state when clamped by the clamp-in unit, five vertex points, respectively inflection points. In particular the flexible-tube delivery element has, in a state when clamped by the clamp-in unit, one vertex point, respectively inflection point, in each of the two peripheral regions, and three vertex points, respectively inflection points, in the middle region, in particular in a delivery-free state of the flexible-tube delivery element.

The delivery direction of the flexible-tube delivery element extends preferentially at least substantially parallel, in particular coaxially, to a longitudinal axis of the flexible-tube delivery element. Preferably the flexible-tube delivery element is embodied in a rotationally symmetrical manner around the longitudinal axis. It is however also conceivable that the flexible-tube delivery element has a different symmetry, deemed expedient by someone skilled in the art, with respect to the longitudinal axis. "At least substantially parallel" is herein in particular to mean an orientation of a direction relative to a reference direction, in particular in a plane, wherein the direction has a deviation from the reference direction in particular by less than 8°, advantageously by less than 5° and especially advantageously by less than 2°. In a state of the flexible-tube delivery element when it is clamped in the clamp-in unit, preferably an inner cross section of the flexible-tube delivery element, which is delimited by a non-abutting inner wall region of the inner wall of the flexible-tube delivery element, defines a delivery space for a delivery of a medium. For a delivery of a medium, in particular a fluid, the flexible-tube delivery element is preferentially configured to be deformed, in particular elastically deformed, in particular in a state when clamped in the clamp-in unit, under an influence of a drive force. The flexible-tube delivery element is preferably configured to allow, by way of a deformation, in particular a repeatable elastic deformation, of the flexible-tube delivery element, a delivery of a medium out of and/or through the delivery space. Preferentially the flexible-tube delivery element is embodied as an expansion-elastic flexible tube.

By an implementation according to the invention, a gentle clamping of a flexible-tube delivery element may advantageously be made possible. A load in peripheral regions of the flexible-tube delivery element, due to crushing that is caused and repeated during delivery, may advantageously be kept at a low level as, by the clamping device according to the invention for a delivery of a medium, the flexible-tube delivery element is preferably repeatedly elastically deformed only in the middle region. Moreover efficient delivery of a medium by way of a clamping of the flexible-tube delivery element is advantageously realizable.

Preferably the convex abutment element is configured to curve the flexible-tube delivery element as a whole, in a state when the flexible-tube delivery element abuts on the convex abutment element, in particular in a state when clamped in the clamp-in unit. The flexible-tube delivery element preferentially abuts on the convex abutment element with an outer surface of the flexible-tube delivery element that faces away from the delivery space of the flexible-tube delivery element, in particular in a state when the flexible-tube delivery element is clamped by the clamp-in unit. The convex abutment element is molded to the clamping element in a one-part implementation. "In a one-part implementation" is in particular to mean connected at least by substance-to-substance bond, e.g. by a welding process, a gluing process, an injection-molding process and/or another process that is deemed expedient by someone skilled in the art, and/or advantageously formed in one piece, e.g. by a production from one cast and/or by a production in a one-component or multi-component injection-molding procedure, and advantageously from a single blank. An implementation according to the invention allows a gentle clamping of a flexible-tube delivery element in a structurally simple fashion. Advantageously a curved clamping of the flexible-tube delivery element may be rendered possible preferably for the purpose of keeping a load in peripheral regions of the flexible-tube delivery element, due to a crushing that is generated and repeated during delivery, at an advantageously low level.

It is further proposed that the clamp-in unit comprises at least the clamping element, which is in particular embodied differently from the drive element of the drive unit and which comprises the convex abutment element that realizes the abutment surface for the flexible-tube delivery element, wherein the convex abutment element comprises a concave recess, at least in one partial region. Preferably the concave recess of the convex abutment element is arranged in a region of the convex abutment element in which, for the purpose of a delivery of a medium, the drive element of the drive unit acts on the flexible-tube delivery element. The flexible-tube delivery element, in particular at least one partial region of the flexible-tube delivery element, is movable towards the concave recess by an impact of a drive force, in particular for a delivery of a medium by the flexible-tube delivery element. Preferentially, in a state of the flexible-tube delivery element when it is under the impact of a drive force, at least two opposite-situated partial regions of the flexible-tube delivery element are arranged at least partly in the concave recess, in particular for a displacement of a medium that is present in the flexible-tube delivery element. Preferably the flexible-tube delivery element is deformable, in particular repeatedly elastically deformable, in such a way that, for a delivery of a medium, the flexible-tube delivery element is movable towards the concave recess of the convex abutment element and is in particular at least partially movable into said concave recess. Thus a dynamic delivery of a medium or a displacing delivery of a medium is advantageously realizable. By an implementation according to the invention, an efficient delivery of a medium is advantageously realizable, due to a clamping of the flexible-tube delivery element. It is moreover possible to facilitate a gentle clamping of a flexible-tube delivery element in a structurally simple manner. It is advantageously possible to facilitate a curved clamping of the flexible-tube delivery element, preferentially for keeping a load, which in peripheral regions of the flexible-tube delivery element results from a crushing caused and repeated during delivery, at an advantageously low level.

It is also proposed that, viewed in a cross section extending transversely to a delivery direction of the flexible-tube delivery element, the concave recess of the convex abutment element is delimited by three circular-arc sections of the convex abutment element, which are arranged in a partial region of the convex abutment element and are directly subsequent to one another. Preferably the partial region of the convex abutment element is arranged to be substantially aligned with an impact region of a drive element of the drive unit, in which, for a delivery of a medium via the flexible-tube delivery element, the drive element acts onto the flexible-tube delivery element, in particular in a state of the clamping device when it is arranged on a pump device. The convex abutment element advantageously features at least in the partial region, viewed in a cross section, a wave-shaped implementation, wherein in particular a wave trough, in particular forming the concave recess, is arranged between two wave crests. Two of the circular-arc sections in particular form wave crests and one of the circular-arc sections forms a wave trough. Especially preferentially the cross section extends in a plane extending at least substantially perpendicularly to the delivery direction. Preferably the circular-arc sections of the rigid wall of the convex abutment element extend in the plane that extends at least substantially perpendicularly to the delivery direction. Due to a clamping of the flexible-tube delivery element, the implementation according to the invention advantageously allows realizing an efficient delivery of a medium. It is further possible to facilitate a gentle clamping of a flexible-tube delivery element in a structurally simple fashion. Advantageously a curved clamping of the flexible-tube delivery element may be rendered possible, preferably for the purpose of keeping a load, which in peripheral regions of the flexible-tube delivery element results from a crushing caused and repeated during delivery, at an advantageously low level.

Beyond this it is proposed that the clamp-in unit comprises at least the clamping element and at least one further clamping element that acts together with the clamping element and delimits at least the concave recess, in which at least the convex abutment element of the clamping element at least partly engages in a state when the clamping element and the further clamping element are connected to one another. For a clamping of the flexible-tube delivery element, the clamping element and the further clamping element are preferably fixatable on one another, in particular in a connection plane of the clamp-in unit. For a fixation of the clamping element and the further clamping element on one another, the clamping device preferably comprises at least one fixation unit. The fixation unit may have any implementation deemed expedient by someone skilled in the art, e.g. an implementation as a screw fixation unit, as a clamp fixation unit, as a bayonet fixation unit, or the like. Preferentially the flexible-tube delivery element is, in a clamped-in state, arrangeable at least partially in the concave recess of the further clamping element by means of the convex abutment element. The concave recess of the further clamping element preferably comprises at least one break-through, through which a drive element of the drive unit may act onto the flexible-tube delivery element that is arranged in the clamp-in unit. Preferentially the convex abutment element extends over and beyond the connection plane in which the clamping element and the further clamping element are connected to one another, and extends in particular into the concave recess of the further clamping element. The clamping element and the further clamping element are preferably embodied as clamp jaws. It is however also conceivable that the clamping element and the further clamping element have a different implementation that is deemed expedient by someone skilled in the art. The implementation according to the invention allows facilitating a gentle clamping of a flexible-tube delivery element in a structurally simple manner. It is advantageously possible to facilitate a curved clamping of the flexible-tube delivery element, preferably for the purpose of keeping a load, which in peripheral regions of the flexible-tube delivery element results from a crushing generated and repeated during delivery, at an advantageously low level.

The clamping element preferentially comprises at least one further angled clamping surface, in particular a further clamping surface that is angled relative to the connection plane. The clamping surface is preferably embodied in a one-part implementation with the convex abutment element. The further clamping surface is preferentially embodied in a one-part implementation with the convex abutment element. The clamping surface and the further clamping surface preferably include an angle which is in particular smaller than 180° and is in particular greater than 45°, preferably greater than 60° and particularly preferably greater than 90°. Preferably the clamping surface and the further clamping surface include an angle having a value between 180° and 100°. In particular, the clamping surface and the further clamping surface of the clamping element delimit the concave recess of the convex abutment element. Advantageously the clamping element comprises at least one adhesive element, which is arranged on the clamping surface. The adhesive element may be realized as a protrusion, as a striated surface, as a roughened surface, as a hook, as an adhesive coating with a large friction coefficient, as a glue coating or as any other adhesive element that is deemed expedient by someone skilled in the art and is configured to exert an adhesive force onto the flexible-tube delivery element in a state when it is clamped in by the clamp-in unit, for the purpose of acting counter to a movement of the flexible-tube delivery element along the clamping surface, in particular transversely to the delivery direction. Preferably the clamping element comprises a further adhesive element, which is arranged on the further clamping surface. In particular, the further adhesive element has an implementation that is at least substantially analogous to the adhesive element. The implementation according to the invention allows, in terms of construction, a curved clamping of the flexible-tube delivery element, preferably for the purpose of keeping a load, which in peripheral regions of the flexible-tube delivery element results from a crushing caused and repeated during delivery, at an advantageously low level. It is advantageously possible to realize a secure clamping in of the flexible-tube delivery element by means of the clamp-in unit.

It is furthermore proposed that the clamp-in unit comprises at least one clamping element and at least one further clamping element that acts together with the clamping element, wherein the clamping element and the further clamping element respectively comprise at least one angled clamping surface, in particular a clamping surface that is angled relative to the connection plane, said angled clamping surfaces being realized to correspond to one another. The further clamping element comprises at least one further angled clamping surface, in particular a further clamping surface that is angled relative to the connection plane. The clamping surface and/or the further clamping surface of the further clamping element are/is preferably embodied in a one-part implementation with the further clamping element. The clamping surface and the further clamping surface of the further clamping element preferably include an angle that is in particular smaller than 180° and is in particular greater than 45°, preferably greater than 60° and particularly preferably greater than 90°. Preferentially the clamping surface and the further clamping surface of the further clamping element include an angle having a value between 180° and 100°. The further clamping element advantageously comprises at least one adhesive element, which is arranged on the clamping surface of the further clamping element. The adhesive element of the further clamping element may be realized as a protrusion, as a striated surface, as a roughened surface, as a hook, as an adhesive coating with a large friction coefficient, as a glue coating or as any other adhesive element that is deemed expedient by someone skilled in the art and is configured to exert an adhesive force onto the flexible-tube delivery element in a state when it is clamped in the clamp-in unit, for the purpose of acting counter to a movement of the flexible-tube delivery element along the clamping surface, in particular transversely to the delivery direction. Preferentially the further clamping element comprises a further adhesive element, which is arranged on the further clamping surface of the further clamping element. In particular, the further adhesive element has an implementation that is at least substantially analogous to the adhesive element. Especially preferentially, in a state when the flexible-tube delivery element is clamped in the clamp-in unit, the flexible-tube delivery element is arranged between the clamping surface and the further clamping surface of the clamping element and between the clamping surface and the further clamping surface of the further clamping element. Preferably, in a state when it is clamped in the clamp-in unit, the flexible-tube delivery element abuts on the clamping surface and the further clamping surface of the clamping element as well as on the clamping surface and the further clamping surface of the further clamping element. The implementation according to the invention advantageously allows realizing a secure clamping of the flexible-tube delivery element by means of the clamp-in unit. It is possible, in terms of construction, to facilitate a curved clamping of the flexible-tube delivery element, preferably for the purpose of keeping a load, which in peripheral regions of the flexible-tube delivery element results from a crushing caused and repeated during delivery, at an advantageously low level.

Moreover it is proposed that at least the angled clamping surface of the further clamping element delimits at least one concave recess, which the flexible-tube delivery element at least partly protrudes into, in at least one clamped state. The clamping surface and/or the further clamping surface of the further clamping element preferably delimit/delimits the concave recess of the further clamping element, which the flexible-tube delivery element at least partially protrudes into in at least one clamped state. By way of the implementation according to the invention, it is advantageously possible to realize a secure clamping of the flexible-tube delivery element by means of the clamp-in unit. It is possible, in terms of construction, to facilitate a curved clamping of the flexible-tube delivery element, preferably for the purpose of keeping a load, which in peripheral regions of the flexible-tube delivery element results from a crushing caused and repeated during delivery, at an advantageously low level.

Furthermore a delivery device, in particular a pump device, is proposed, with at least one clamping device according to the invention, with at least one flexible-tube delivery element and with at least one drive unit for generating a drive force that acts onto the flexible-tube delivery element. It is also conceivable that the delivery device comprises a plurality of flexible-tube delivery elements, which are clampable by the clamping device. The clamping device may be configured to clamp a plurality of flexible-tube delivery elements in such a way that by means of the drive unit, in particular by means of a drive element, a drive force is exertable onto all clamped-in flexible-tube delivery elements. Preferably the flexible-tube delivery element is drivable by means of the drive unit in such a way that it is possible to facilitate a delivery of a medium following a traveling-wave principle (cf., for example, the disclosure of EP 1 317 626 B1). The drive unit may be realized as a mechanical drive unit, as a magnetic drive unit, as a piezoelectrical drive unit, as a hydraulic drive unit, as a pneumatic drive unit, as an electrical drive unit, as a magnetorheological drive unit, as a carbon-tubes drive unit, as a combination of any of the above types of drive units, or as a different drive unit that is deemed expedient by someone skilled in the art. Preferably the drive unit comprises at least one drive element which is configured to act onto the flexible-tube delivery element and is in particular configured to cause an elastic deformation of the flexible-tube delivery element due to an impact of a drive force onto the flexible-tube delivery element. The drive element may feature any implementation that is deemed expedient by someone skilled in the art like, for example, an implementation as a tappet, as a protrusion, as a helix, as a nub, as a piezo element, as a magnet, as an eccentric, or the like. The drive unit preferentially comprises at least one electromotor unit, which is in particular configured for driving at least the drive element. It is however also conceivable that the drive unit comprises a different motor unit that is deemed expedient by someone skilled in the art, e.g. a combustion motor unit, a hybrid motor unit, or the like. The delivery device preferably comprises at least one housing unit which the clamping device is arrangeable on, in particular arrangeable in such a way that it is exchangeable.

The drive unit is preferentially implemented as a helical drive unit or as an eccentric drive unit. By a "helical drive unit" is here in particular a drive unit to be understood which comprises at least one helix-like drive element, which is in particular configured for an impact of a drive force, in particular a direct impact of a drive force, onto the flexible-tube delivery element. It is however also conceivable that the drive unit features a different implementation that is deemed expedient by someone skilled in the art like, for example, an implementation as a paternoster drive unit, as a crown wheel drive unit, or the like. By a "paternoster drive unit" is here in particular a drive unit to be understood that comprises at least one force-impact element, which is in particular drivable in a circulation drive, in particular for an impact of a drive force, in particular a direct impact of a drive force, onto the flexible-tube delivery element, wherein, for an impact of a drive force onto the flexible-tube delivery element, in particular the force-impact element extends at least substantially parallel to a circulation plane, in particular in the circulation plane in which the force-impact element is drivable in a circulation operation. By a "crown wheel drive unit" is here in particular a drive unit to be understood that comprises at least one drive element which is arranged on a rotationally drivable crown element, in particular for an impact of a drive force, in particular a direct impact of a drive force onto the flexible-tube delivery element, wherein, for an impact of a drive force onto the flexible-tube delivery element, in particular the drive element extends at least substantially parallel to a rotational axis of the crown element.

The drive unit preferably comprises at least one drive element which is embodied as a helix or at least one drive element which is embodied as an eccentric. Preferentially the drive element is configured for acting onto the flexible-tube delivery element directly. It is however also conceivable that at least one further element or further elements is/are arranged between the drive element and the flexible-tube delivery element like, for example, a friction-reducing element, a support element, a gentle-handling element configured for a gentle handling of an outer surface of the flexible-tube delivery element in an impact of the drive element onto the flexible-tube delivery element, or the like. If implemented as a drive helix, the drive element may comprise one helix element or a plurality of helix elements having, for example, a circle-segment-like cross section, a wave-like cross section, in particular a wave-like cross section with at least two wave crests and one wave trough, wherein the wave crests may have the same or differing maximum heights. The helix element/s may be realized of a spring-elastic material or of the same material as a base body of the drive element. Further implementations of the drive element, which are deemed expedient by someone skilled in the art, are also conceivable. Advantageously at least one drive axis of the drive unit extends at least substantially parallel to the delivery direction of the flexible-tube delivery element, in particular to a delivery direction in the delivery space. If the drive unit is embodied as a helical drive unit or as an eccentric drive unit, a rotational axis of the drive element embodied as a helix or of the drive element embodied as an eccentric, realizing the drive axis of the drive unit, preferably extends at least substantially parallel to the delivery direction in the delivery space. Preferentially a rotational axis of a rotor element of the electromotor unit of the drive unit extends at least substantially parallel to the delivery direction in the delivery space. The rotational axis of the rotor element of the electromotor unit preferably implements a further drive axis, which extends at least substantially parallel to the delivery direction in the delivery space.

Preferentially the pump device comprises at least one delivery medium storage unit for a storage of a medium, in particular a fluid, that is deliverable via the flexible-tube delivery element. By a "delivery medium storage unit" is here in particular a unit to be understood that comprises at least one storage space which a medium, in particular a fluid, is storable in. Preferably a volume of the storage space of the delivery medium storage unit is at least greater than a volume of the delivery space. Preferentially the delivery medium storage unit is embodied tank-like. The delivery medium storage unit may herein be implemented as a carpule, as an ampoule, as a cartridge, or the like. The delivery medium storage unit is preferably fluidically connected with the delivery space. Preferentially an exit of the delivery medium storage unit is connected, in particular fluid-tightly connected, with the delivery space entry of the delivery space by at least one channel of the delivery device, in particular by the flexible-tube delivery element. It is thus advantageously possible to convey a medium stored in the storage space of the delivery medium storage unit out of the storage space by way of a cooperation with the flexible-tube delivery element.

The pump device is preferably configured for a usage in the medical field. It is however also conceivable that the pump device is configured for a usage in other fields like, for example, in a food sector, in a chemical field, in a pharmaceutical sector, in particular for a batch-conform usage, in a vivarium sector (aquariums etc.), in a field of household appliances, in a dental-hygiene field, or the like. By the implementation according to the invention it is advantageously possible to realize efficient delivery of a medium by a clamping-in of the flexible-tube delivery element.

It is further proposed that the clamp-in unit comprises at least the clamping element and at least one further clamping element which acts together with the clamping element and which delimits at least one concave recess that, for an impact of a drive force onto the flexible-tube delivery element, at least the drive element of the drive unit engages in at least partially. Preferably a drive element of the drive unit, which is embodied as a helix, engages at least partially in the concave recess of the further clamping element. By the implementation according to the invention it is advantageously possible to achieve efficient delivery of a medium. Moreover a compact implementation of the delivery device is advantageously achievable.

The clamping device according to the invention and/or the delivery device according to the invention are/is herein not to be restricted to the application and implementation described above. In particular, for the purpose of fulfilling a functionality that is described here, the clamping device according to the invention and/or the delivery device according to the invention may comprise a number of respective elements, structural components and units as well as method steps that differs from a number given here. Moreover, regarding the value ranges given in the present disclosure, values within the limits named are also to be considered to be disclosed and to be insertable according to requirements.

DRAWINGS

Further advantages will become apparent from the following description of the drawings. The drawings show an exemplary embodiment of the invention. The drawings, the description and the claims contain a plurality of features in combination. Someone skilled in the art will purposefully also consider the features separately and will find further expedient combinations.

Figure 2:
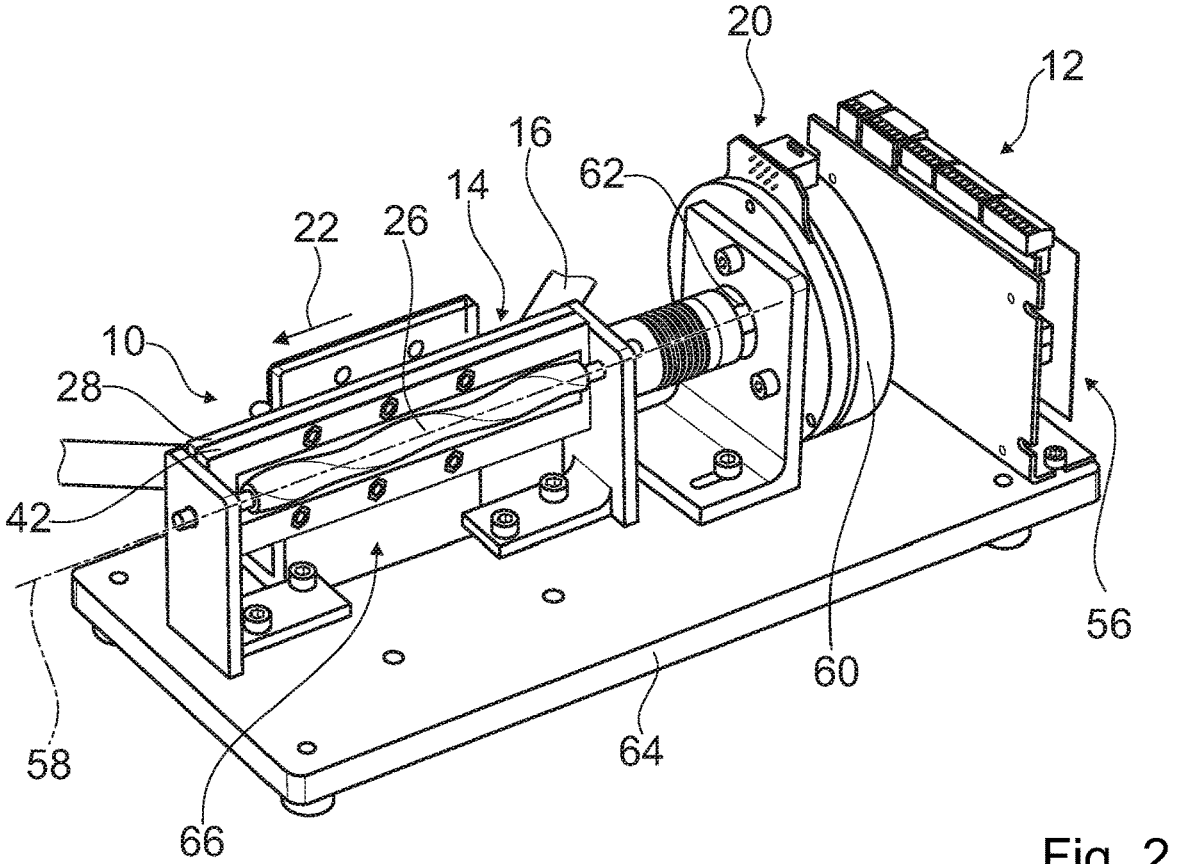
Figure 3:
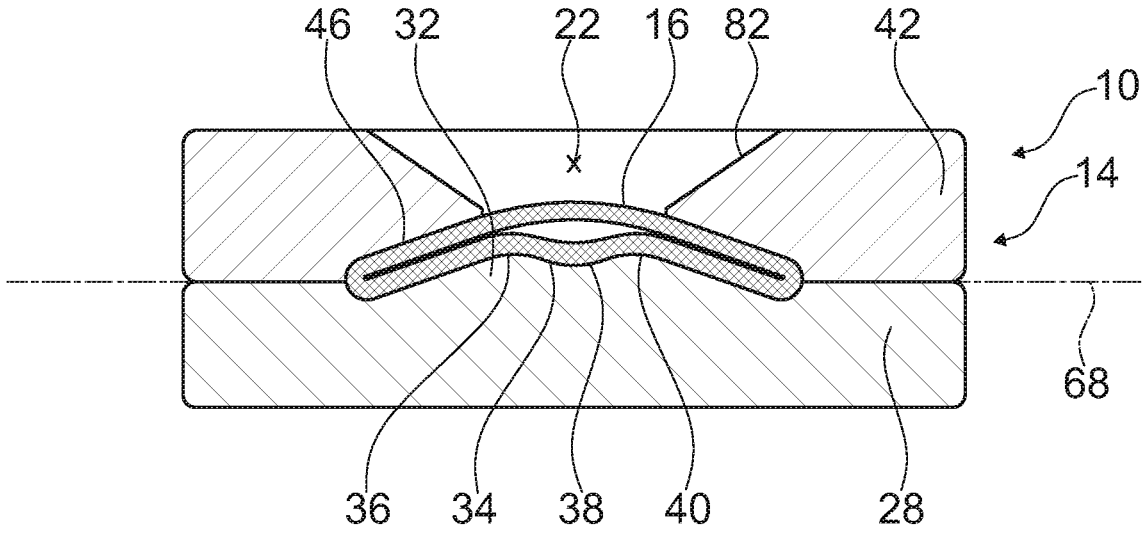
Figure 4:
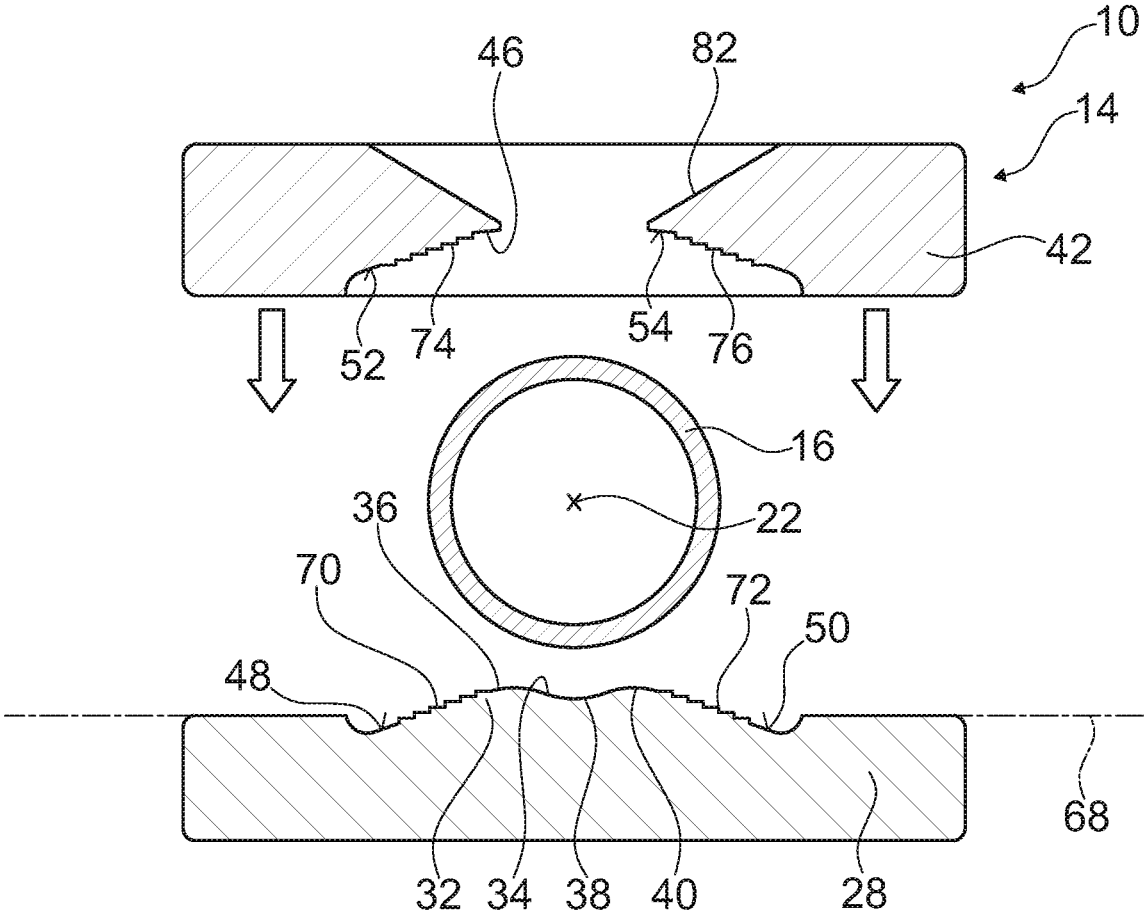
Figure 5:
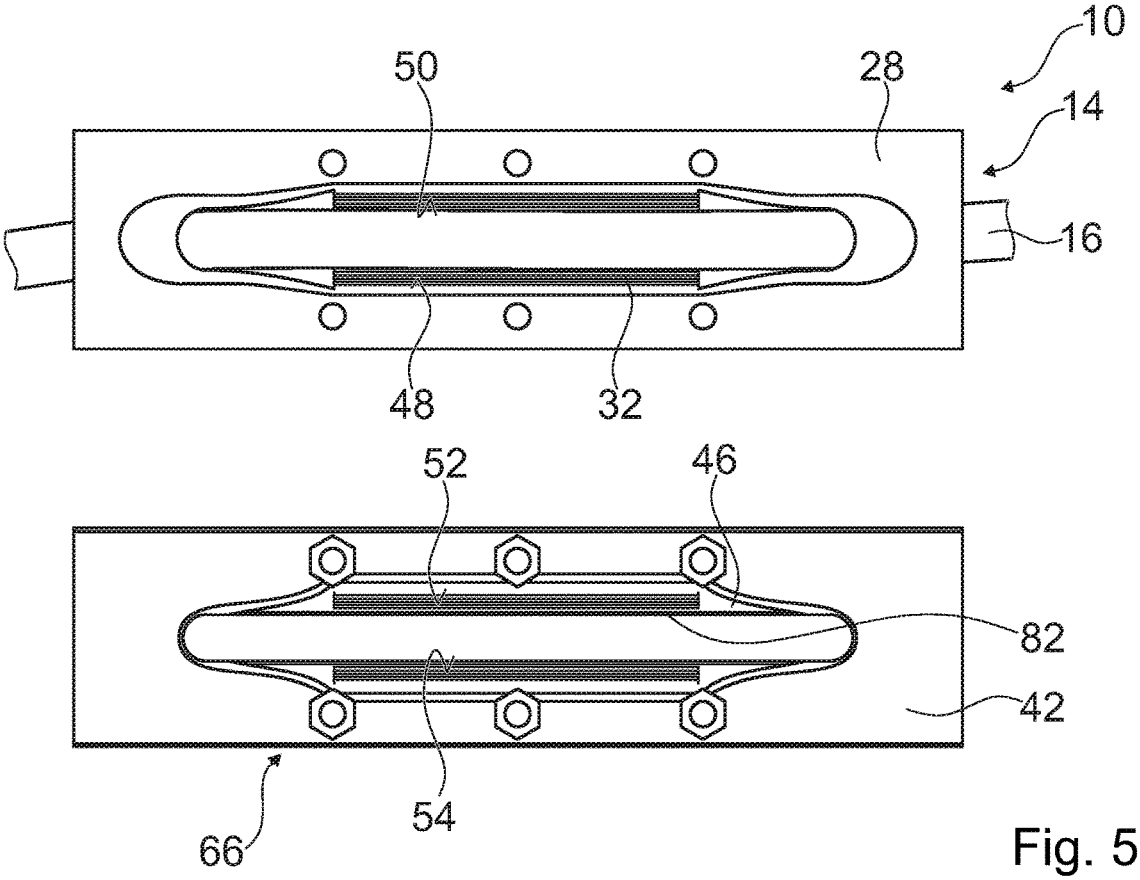
Figure 6:
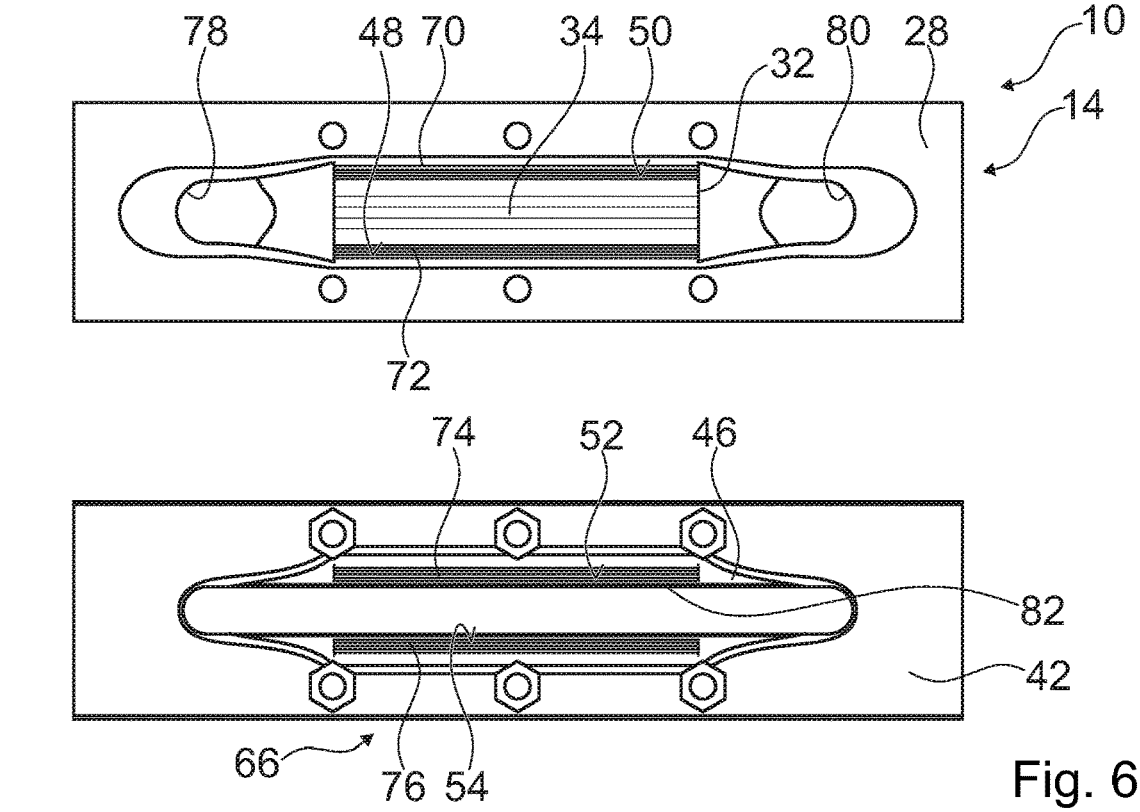

It is shown in:

FIG. 1 a delivery device according to the invention with at least one clamping device according to the invention, in a schematic representation, FIG. 2 the delivery device according to the invention with at least one partially demounted clamping device according to the invention, in a schematic representation, FIG. 3 a cross section of the clamping device according to the invention in a clamped-in state of a flexible-tube delivery element of the delivery device according to the invention, in a schematic representation, FIG. 4 a cross section of the clamping device according to the invention in a non-clamped state of the flexible-tube delivery element of the delivery device according to the invention, in a schematic representation, FIG. 5 a detail view of a clamp-in unit of the clamping device according to the invention, with the flexible-tube delivery element arranged therein, in a schematic representation, and FIG. 6 a detail view of the clamp-in unit of the clamping device according to the invention, without the flexible-tube delivery element arranged therein, in a schematic representation.

DESCRIPTION OF THE EXEMPLARY EMBODIMENT

FIG. 1 shows a delivery device 12 with at least one clamping device 10 and with at least one drive unit 20 for the purpose of generating a drive force that acts onto at least one flexible-tube delivery element 16, 18 of the delivery device 12. The delivery device 12 is implemented as a pump device, in particular as a flexible-tube pump device. In the exemplary embodiment illustrated in FIG. 1, to improve comprehensibility, the delivery device 12 is depicted without a housing unit of the delivery device 12. The housing unit of the delivery device 12 may feature any implementation deemed expedient by someone skilled in the art. In particular, in a manner that is well-known to someone skilled in the art, the housing unit is configured to at least partially envelop and/or support components of the delivery device 12. In the exemplary embodiment illustrated in FIG. 1 a base plate 64 of the delivery device 12 is shown, which the housing unit is fixatable on.

For a control and/or regulation of the drive unit 20, the delivery device 12 comprises at least one control and/or regulation unit 56 having an implementation that is already known to someone skilled in the art. The drive unit 20 is implemented as a helical drive unit or as an eccentric drive unit. At least one drive axis 58 of a drive element 26 of the drive unit 20 extends at least substantially in parallel to a delivery direction 22, 24 of at least one flexible-tube delivery element 16, 18 of the delivery device 12, in particular at least substantially in parallel to a delivery direction 22, 24 through at least one delivery space of the flexible-tube delivery element 16, 18. The drive element 26 is embodied as a drive helix or as an eccentric shaft (FIG. 2). The drive element 26 is rotatably supported in the housing unit (not shown here) of the delivery device 12 or on the base plate 64, in a manner that is already known to someone skilled in the art. The drive axis 58 is implemented as a rotational axis of the drive element 26. For a delivery of a medium, the drive element 26 is configured to elastically deflect and/or deform the at least one flexible-tube delivery element 16, 18, in particular in a state when the flexible-tube delivery element 16, 18 is clamped in by a clamp-in unit 14 of the clamping device 10. The flexible-tube delivery element 16, 18 is embodied in such a way that it is elastically deformable. The drive element 26 is configured to generate a traveling-wave movement of the flexible-tube delivery element 16, 18 along a longitudinal axis of the flexible-tube delivery element 16, 18. It is conceivable that the drive element 26 acts onto the flexible-tube delivery element 16, 18 directly or that an exciter element (not shown here in detail) of the delivery device 12, which the drive element 26 acts on directly, is arranged between the drive element 26 and the flexible-tube delivery element 16, 18, the exciter element transferring an impact of drive forces onto the flexible-tube delivery element 16, 18 that is at least partially adjacent to the exciter element. In the exemplary embodiment illustrated in FIG. 1, two clamp-in units 14 of the clamping device 10 are arranged so as to be distributed around the drive element 26. It is however also conceivable that the clamping device 10 comprises a plurality of clamp-in units 14 differing from one or two, said clamp-in units 14 being configured to clamp in at least one flexible-tube delivery element 16, 18 respectively. Preferably all clamp-in units 14 of the clamping device 10 feature at least substantially analogous implementations.

For a movement, in particular a rotation, of the drive element 26, the drive unit 20 comprises at least one motor unit 60. The motor unit 60 is implemented as an electromotor unit. It is however also conceivable that the motor unit 60 features a different implementation that is deemed expedient by someone skilled in the art like, for example, an implementation as a combustion motor unit, as a hybrid motor unit, or the like. The drive element 26 may be connected to a rotor shaft 62 of the motor unit 60 directly, in particular in a rotationally fixed manner, or indirectly, e.g. by means of a gear unit of the delivery device 12 or by at least one toothed-wheel element of the delivery device 12. The rotor shaft 62 has a rotational axis that extends at least substantially in parallel, in particular coaxially, to the drive axis 58 of the drive element 26. Other implementations and/or arrangements of the connection between the drive element 26 and the motor unit 60 are also conceivable, for example by means of an angular gear unit, by a switchable clutch, or the like. The delivery device 12 furthermore comprises at least one delivery medium storage unit (not shown here in detail) for a storage of a medium that is to be delivered, wherein, for a delivery of the medium, the delivery medium storage unit is connected at least to the flexible-tube delivery element 16, 18.

FIG. 3 shows a sectional view of the clamping device 10. The clamping device 10 for the delivery device 12 comprises at least one clamp-in unit 14 for a clamping of the at least one flexible-tube delivery element 16, 18 of the delivery device 12, wherein for a delivery of a medium, by means of the drive unit 20 of the delivery device 12, a drive force is exertable on the flexible-tube delivery element 16, 18 at least in a state when arranged in the clamp-in unit 14. The clamp-in unit 14 is configured to clamp the flexible-tube delivery element 16, in such a way that it is curved as a whole when viewed in a cross section extending transversely to the delivery direction 22, 24 of the flexible-tube delivery element 16, 18. In FIG. 3 the flexible-tube delivery element 16, 18 clamped by the clamp-in unit 14 is shown in a delivery-free state of the flexible-tube delivery element 16, 18. The clamp-in unit 14 is preferably configured to clamp the flexible-tube delivery element 16, 18 in such a way that it is as a whole at least substantially arc-shaped, viewed in a cross section extending transversely to the delivery direction 22, 24 of the flexible-tube delivery element 16, 18, wherein in particular opposite-situated inner wall regions of the flexible-tube delivery element 16, 18 abut on each other. Particularly preferably the flexible-tube delivery element 16, 18 has, in a state when clamped by the clamp-in unit 14, an arc-like shape at least in a middle region of the flexible-tube delivery element 16, 18, wherein peripheral regions of the flexible-tube delivery element 16, 18, which are adjacent to the middle region and in which in particular at least more than 50% of a total extension of the inner wall of the flexible-tube delivery element 16, 18 abut on each other, extend, starting from the middle region, tangentially away from the middle region.

Preferentially, due to a clamping in the clamp-in unit 14, the flexible-tube delivery element 16, 18, when viewed in a cross section extending transversely to a delivery direction 22, 24 of the flexible-tube delivery element 16, 18, is transferred, starting from a circular shape (cf. FIG. 4), into a curved, in particular an arc-shaped, shape, in which inner wall sections of the flexible-tube delivery element 16, 18 at least partly abut on one another (FIG. 3).

The clamp-in unit 14 comprises at least one clamping element 28, 30, which is in particular embodied differently than the drive element 26 of the drive unit 20, and which comprises a convex abutment element 32 that realizes an abutment surface for the flexible-tube delivery element 16, 18. The convex abutment element 32 comprises, at least in a partial region of the convex abutment element 32, a concave recess 34. When viewed in a cross section extending transversely to the delivery direction 22, 24 of the flexible-tube delivery element 16, 18, the concave recess 34 of the convex abutment element 32, is delimited by three circular-arc sections 36, 38, 40 of the convex abutment element 32, which are arranged in a partial region of the convex abutment element 32 and directly follow upon one another. The clamp-in unit 14 comprises at least the clamping element 28, 30 and at least one further clamping element 42, 44 that acts together with the clamping element 28, 30 and delimits at least one concave recess 46, in which at least the convex abutment element 32 engages at least partially in a state when the clamping element 28, 30 and the further clamping element 42, 44 are connected to one another. The further clamping element 42, 44 delimits at least the concave recess 46, which at least the drive element 26 of the drive unit 20 engages in at least partially for an impact of a drive force onto the flexible-tube delivery element 16, 18.

For a clamping in of the flexible-tube delivery element 16, 18, the clamping element 28, 30 and the further clamping element 42, 44 are preferably fixatable on each other, in particular in a connection plane 68 of the clamp-in unit 14. For a fixation of the clamping element 28, 30 and the further clamping element 42, 44 on each other, the clamping device 10 preferably comprises at least one fixation unit 66 (FIGS. 1, 5 and 6). The fixation unit 66 may have any implementation deemed expedient by someone skilled in the art like, for example, an implementation as a screw fixation unit, as a clamp fixation unit, as a bayonet fixation unit, or the like. Preferentially, the flexible-tube delivery element 16, 18 is, in a clamped-in state, arrangeable at least partly in the concave recess 46 of the further clamping element 42, 44 by means of the convex abutment element 32. The concave recess 46 of the further clamping element 42, 44 preferably comprises at least one break-through 82, through which the drive element 26 of the drive unit 20 is enabled to act onto the flexible-tube delivery element 16, 18 that is arranged in the clamp-in unit 14. The convex abutment element 32 preferably extends over and beyond the connection plane 68, in which the clamping element 28, 30 and the further clamping element 42, 44 are connected to one another, in particular into the concave recess 46 of the further clamping element 42, 44. The clamping element 28, 30 and the further clamping element 42, 44 are preferably embodied as clamp jaws. It is however also conceivable that the clamping element 28, 30 and/or the further clamping element 42, 44 have/has different implementations deemed expedient by someone skilled in the art.

The clamping element 28, 30 comprises at least one angled clamping surface 48, in particular a clamping surface 48 that is angled relative to the connection plane 68. Preferably the clamping element 28, 30 comprises at least one further angled clamping surface 50, in particular a further angled clamping surface 50 that is angled relative to the connection plane 68. The clamping surface 48 of the clamping element 28, 30 is preferentially embodied in a one-part implementation with the convex abutment element 32. The further clamping surface 50 of the clamping element 28, 30 is preferentially embodied in a one-part implementation with the convex abutment element 32. The clamping surface 48 and the further clamping surface 50 of the clamping element 28, 30 preferably include an angle that is in particular smaller than 180° and greater than 45°. In particular, the clamping surface 48 and the further clamping surface 50 of the clamping element 28, 30 delimit the concave recess 34 of the convex abutment element 32. Advantageously the clamping element 28, 30 comprises at least one adhesive element 70, which is arranged on the clamping surface 48 of the clamping element 28, 30 (FIGS. 4 to 6). The adhesive element 70 is configured to exert an adhesion force onto the flexible-tube delivery element 16, 18 in a state when clamped by the clamp-in unit 14, for the purpose of acting counter to a movement of the flexible-tube delivery element 16, 18 along the clamping surface 48, in particular transversely to the delivery direction 22, 24. Preferably the clamping element 28, 30 comprises a further adhesive element 72, which is arranged on the further clamping surface 50 of the clamping element 28, 30. In particular, the further adhesive element 72 features an implementation that is at least substantially analogous to the adhesive element 70. Preferentially the clamping element 28, 30 comprises a plurality of adhesive elements 70 and further adhesive elements 72, which are arranged on the clamping surface 48 and the further clamping surface 50 of the clamping element 28, 30.

The clamp-in unit 14 comprises at least the clamping element 28, 30 and at least the further clamping element 42, 44 that acts together with the clamping element 28, 30, wherein the clamping element 28, 30 and the further clamping element 42, 44 respectively comprise at least one angled clamping surface 48, 50, 52, 54, said clamping surfaces 48, 50, 52, 54 being embodied correspondingly to one another. The further clamping element 42, 44 comprises at least one angled clamping surface 52, in particular a clamping surface 52 that is angled relative to the connection plane 68. The further clamping element 42, 44 comprises at least one further angled clamping surface 54, in particular a clamping surface 54 that is angled relative to the connection plane 68. The clamping surface 52 and/or the further clamping surface 54 of the further clamping element 42, 44 are/is preferably embodied in a one-part implementation with the further clamping element 42, 44. The clamping surface 52 and/or the further clamping surface 54 of the further clamping element 42, 44 preferably delimit/delimits at least the concave recess 46 of the further clamping element 42, 44, which the flexible-tube delivery element 16, 18 protrudes into at least partly in at least one clamped state.

Advantageously the further clamping element 42, 44 comprises at least one adhesive element 74, which is arranged on the clamping surface 52 of the further clamping element 42, 44 (FIGS. 4 to 6). The adhesive element 74 is configured to exert an adhesion force onto the flexible-tube delivery element 16, 18 in a state when clamped by the clamp-in unit 14, for the purpose of acting counter to a movement of the flexible-tube delivery element 16, 18 along the clamping surface 52, in particular transversely to the delivery direction 22, 24. Preferably the further clamping element 42, 44 comprises a further adhesive element 76, which is arranged on the further clamping surface 54 of the further clamping element 42, 44. In particular, the further adhesive element 76 has an implementation that is at least substantially analogous to the adhesive element 74.

Especially preferentially, in a state when clamped in by the clamp-in unit 14, the flexible-tube delivery element 16, 18 is arranged between the clamping surface 48 and the further clamping surface 50 of the clamping element 28, 30, and the clamping surface 52 and the further clamping surface 54 of the further clamping element 42, 44. Preferably, in a state when clamped by the clamp-in unit 14, the flexible-tube delivery element 16, 18 is adjacent to the clamping surface 48 and the further clamping surface 50 of the clamping element 28, 30 and to the clamping surface 52 and the further clamping surface 54 of the further clamping element 42, 44.

The clamping element 28, 30 comprises at least one feed-in opening 78, via which the flexible-tube delivery element 16, 18 is guidable from one side of the clamping element 28, 30 to another side of the clamping element 28, 30, on which the convex abutment element 32 is arranged. The clamping element 28, 30 comprises at least one feed-out opening 80, via which the flexible-tube delivery element 16, 18 is guidable from the side of the clamping element 28, 30 on which the convex abutment element 32 is arranged to the other side of the clamping element 28, 30 that faces away from the convex abutment element 32. Via the feed-in opening 78 and the further feed-out opening 80, the flexible-tube delivery element 16, 18 is arrangeable on the clamp-in unit 14 in such a way that at least a partial region of the flexible-tube delivery element 16, 18 is arrangeable free from a drive force impact, in particular for a connection of the flexible-tube delivery element 16, 18, for example, to a dosage unit, to an output unit, to the delivery medium storage unit, or the like. The convey abutment element 32 is, when viewed along the delivery direction 22, 24 of the flexible-tube delivery element 16, 18, arranged between the feed-in opening 78 and the feed-out opening 80. Preferably, viewed along the delivery direction 22, 24 of the flexible-tube delivery element 16, 18, the feed-in opening 78 is arranged upstream of the convex abutment element 32. Preferentially, viewed along the delivery direction 22, 24 of the flexible-tube delivery element 16, 18, the feed-out opening 80 is arranged downstream of the convex abutment element 32. However, a reverse arrangement of the feed-in opening 78 and the feed-out opening 80 is also conceivable.

REFERENCE NUMERALS

10 clamping device
12 delivery device
14 clamp-in unit
16 flexible-tube delivery element
18 flexible-tube delivery element
20 drive unit
22 delivery direction
24 delivery direction
26 drive element
28 clamping element
30 clamping element
32 abutment element
34 concave recess
36 circular-arc section
38 circular-arc section
40 circular-arc section
42 clamping element
44 clamping element
46 concave recess
48 clamping surface
50 clamping surface
52 clamping surface
54 clamping surface
56 control and/or regulation unit
58 drive axis
60 motor unit
62 rotor shaft
64 base plate
66 fixation unit
68 connection plane
70 adhesive element
72 adhesive element
74 adhesive element
76 adhesive element
78 feed-in opening
80 feed-out opening
82 break-through

The invention claimed is:

1. A clamping device for a delivery device, comprising:

at least one clamp-in unit for clamping in at least one flexible-tube delivery element of the delivery device, wherein:

for a delivery of a medium, a drive force is exertable on said at least one flexible-tube delivery element by means of a drive unit of the delivery device, at least in a state when the at least one flexible-tube delivery element is arranged in the clamp-in unit, the clamp-in unit is configured to clamp the at least one flexible-tube delivery element in such a way that it is curved as a whole, viewed in a cross section extending transversely to a delivery direction of the at least one flexible-tube delivery element, the clamp-in unit comprises at least one clamping element, which differs from a drive element of the drive unit and which comprises a convex abutment element realizing an abutment surface for the at least one flexible-tube delivery element, the at least one clamping element has at least one angled clamping surface, the at least one clamping element comprises at least one adhesive element that is arranged on the at least one angled clamping surface of the at least one clamping element, the clamp-in unit comprises at least one further clamping element that acts together with the at least one clamping element and delimits at least one concave recess, and the at least one concave recess comprises at least one breakthrough through which the drive element of the drive unit at least partially engages the at least one flexible-tube delivery element.

2. The clamping device according to claim 1, wherein the convex abutment element comprises-a at least one further concave recess, at least in a partial region.

3. The clamping device according to claim 2, wherein viewed in a cross section extending transversely to the delivery direction of the at least one flexible-tube delivery element, the at least one further concave recess of the convex abutment element is delimited by three circular arc sections of the convex abutment element, which are arranged in a partial region of the convex abutment element and are directly subsequent to one another.

4. The clamping device according to claim 1, wherein the convex abutment element of the at least one clamping element at least partly engages the at least one concave recess in a state when the at least one clamping element and the at least one further clamping element are connected to one another.

5. The clamping device according to claim 1, wherein the at least one further clamping element comprises at least one further angled clamping surface, and the least one further clamping element acts together with the at least one clamping element whereby said at least one angled clamping surface and said at least one further angled clamping surface are realized to correspond to one another.

6. The clamping device according to claim 5, wherein the at least one further angled clamping surface of the at least one further clamping element comprises the at least one further concave recess, which the at least one flexible-tube delivery element at least partly protrudes into, in at least one clamped state.

7. A delivery device, comprising:

at least one clamping device, at least one flexible-tube delivery element, and at least one drive unit for generating a drive force that acts on the at least one flexible-tube delivery element, wherein:

the at least one clamping device comprises at least one clamp-in unit for clamping in the at least one flexible-tube delivery element, the drive force acts onto the at least one flexible-tube delivery element for delivery of a medium at least in a state when the at least one flexible-tube delivery element is arranged in the clamp-in unit, the clamp-in unit is configured to clamp the at least one flexible-tube delivery element in such a way that it is curved as a whole, viewed in a cross section extending transversely to a delivery direction of the at least one flexible-tube delivery element, the clamp-in unit comprises at least one clamping element, which differs from a drive element of the drive unit and which comprises a convex abutment element realizing an abutment surface for the at least one flexible-tube delivery element, the at least one clamping element has at least one angled clamping surface, the at least one clamping element comprises at least one adhesive element that is arranged on the at least one angled clamping surface of the at least one clamping element, the clamp-in unit comprises at least one further clamping element that acts together with the at least one clamping element and delimits at least one concave recess, and the at least one concave recess comprises at least one breakthrough through which the drive element at least partially engages the at least one flexible-tube delivery element.

8. The delivery device according to claim 7, further comprising a base plate onto which each of the at least one clamping device, the at least one flexible-tube delivery element, and the at least one drive unit are affixed.

* * * * *